United States Patent [19]

Cortopassi

[11] Patent Number: 4,608,259

[45] Date of Patent: Aug. 26, 1986

[54] POCKET WRAP

[75] Inventor: Jeffery J. Cortopassi, Santa Ana, Calif.

[73] Assignee: Taco Bell, Irvine, Calif.

[21] Appl. No.: 793,445

[22] Filed: Oct. 28, 1985

Related U.S. Application Data

[63] Continuation of Ser. No. 673,579, Nov. 21, 1984, abandoned.

[51] Int. Cl.[4] ..... B65D 30/00; B65D 85/00

[52] U.S. Cl. ..... 426/115; 229/72; 229/87 F; 229/87.5; 229/DIG. 13; 383/41; 383/86

[58] Field of Search ..... 229/87 F, 72, 1.5 R, 229/DIG. 13, 87.5; 383/66, 41, 86; 426/115, 410

[56] References Cited

U.S. PATENT DOCUMENTS

| | | | |
|---|---|---|---|
| 1,732,680 | 10/1929 | Hanlon | 383/41 |
| 1,774,215 | 8/1930 | Weinthrop | 229/87 F |
| 2,240,072 | 4/1941 | Hodgdon et al. | 229/87 F |
| 2,248,843 | 7/1941 | Atwood | 229/DIG. 13 |
| 2,433,663 | 12/1947 | Hanson | 229/87 F |
| 2,893,876 | 7/1959 | Murphy | 229/87 F |
| 3,077,410 | 2/1963 | Kanaga | 229/87 F |
| 3,655,119 | 4/1972 | Thompson | 229/72 |
| 4,051,996 | 10/1977 | Ross et al. | 229/72 |

FOREIGN PATENT DOCUMENTS

| | | | |
|---|---|---|---|
| 88165 | 8/1956 | Norway | 383/66 |

*Primary Examiner*—Stephen P. Garbe

*Attorney, Agent, or Firm*—Scully, Scott, Murphy & Presser

[57] ABSTRACT

A simple and versatile pocket wrap for a comestible product which is frequently hand held during consumption. The wrap is constructed to provide a pocket adapted to enclose the comestible product, with the pocket being formed by front and back sheets which are joined along both a first side edge and a bottom edge, and which are openable and detached along both a second side edge and a top edge. The relatively open pocket enables a comestible product to be easily inserted therein, and also allows the comestible product to be conveniently relocated in the pocket to extend therefrom during consumption while still remaining wrapped therein. An overwrap sheet is formed integrally with the pocket back sheet, and extends upwardly therefrom, with the overwrap sheet being designed to be folded downwardly over the pocket front sheet after insertion of a comestible product into the pocket, thereby wrapping and packaging the comestible product in a manner suitable for initial delivery to a customer. The pocket front and back sheets and the overwrap sheet are preferably integrally formed from one generally rectangular blank of paper material.

6 Claims, 6 Drawing Figures

POCKET WRAP

This application is a continuation of application Ser. No. 673,579, filed Nov. 21, 1984, now abandoned.

BACKGROUND OF THE INVENTION

1. Field of the Invention

The present invention relates generally to a versatile pocket wrap for a comestible product, such as a taco or a burrito, which provides a product overwrap, and which also serves as a convenient wrap for the product to be hand held in during consumption. More particularly, the subject invention pertains to a pocket wrap which is formed from a simple and relatively inexpensive paper blank, such that it is designed to be disposable and thereby particularly useful for fast food operations.

2. Discussion of the Prior Art

Fast food restaurants typically sell a large number of comestible products such as burritos, tacos, hot dogs, sandwiches, croissants, hot pretzels, etc. which are usually wrapped for delivery to a customer, and which are normally hand held during consumption at a nearby table or booth or as a take-out item. Wrapping of these fast food comestible products should be accomplished relatively easily and fast, and the wrapping or packaging materials should be designed with minimal costs as these items are normally disposable throw-away items. In view of these cost constraints, these products are frequently wrapped with only a rectangular paper overwrap, the usage of which during wrapping is relatively time consuming, and further the packaged product does not provide a particularly convenient wrap designed to provide for manual handling of the product while it is being consumed.

SUMMARY OF THE INVENTION

Accordingly, it is a primary object of the present invention to provide a pocket wrap for a comestible product which is typically held by hand during consumption, such as a taco, burrito, hot dog, croissant, hamburger, sandwich, hot pretzel, etc., or other similar hand held comestible product, and which aids in consumption of the product by allowing it to remain wrapped in a pocket provided thereby to allow the wrapped product to be hand held during consumption.

An additional object of the present invention is to provide a pocket wrap of the type described which reduces wrapping time of the comestible product, a significant consideration in a typical fast food operation.

A further object of the present invention is the provision of a pocket wrap of the type described which is relatively inexpensive, also a significant consideration for a fast food wrap, which is typically disposed of after a single usage. The pocket wrap of the subject invention is constructed in a relatively simple manner from an easily manufactured blank formed from a relatively inexpensive material such as paper, coated paper, or paper laminated to foil.

An additional object of the subject invention is the provision of a pocket wrap, the design of which allows printed graphics to be registered with the product placement therein.

In accordance with the teachings herein, the present invention provides a simple and versatile pocket wrap for a comestible product which is frequently hand held during consumption. The wrap is constructed to provide a pocket adapted to enclose the comestible product, with the pocket being formed by front and back sheets which are joined along both a first side edge and a bottom edge, and which are openable and detached along both a second side edge and a top edge. The relatively open pocket enables a comestible product to be easily inserted therein, and also allows the comestible product to be conveniently relocated in the pocket to extend therefrom during consumption while still remaining wrapped therein. The wrapping thus allows a consumer to hold the wrapped product during consumption without any direct and possibly messy handling of the comestible itself.

Moreover, an overwrap sheet is also formed integrally with the pocket back sheet, and extends upwardly therefrom, with the overwrap sheet being designed to be folded downwardly over the pocket front sheet after insertion of a comestible product into the pocket, thereby wrapping and packaging the comestible product in a manner suitable for initial delivery to a customer.

In greater detail, the pocket is generally rectangular in shape, with the top and bottom edges of the pocket extending along the length of the pocket. The overwrap sheet is also generally rectangular in shape, having approximately the same length and width as the pocket. Moreover, the pocket front and back sheets and the overwrap sheet are preferably integrally formed from one generally rectangular sheet of paper material folded once along the bottom edge of the pocket and folded a second time to form an inwardly extending tab along the first side edge.

The pocket back sheet can also be provided with a decorative printed sheet overlaying the outer surface thereof, providing for decorative and trademark printing thereon, and also reinforcing the strength of the pocket. The decorative printed sheet is preferably substantially coextensive with, or slightly smaller than, the rectangular pocket back sheet.

BRIEF DESCRIPTION OF THE DRAWINGS

The foregoing objects and advantages of the present invention for a versatile pocket wrap may be more readily understood by one skilled in the art, with reference being had to the following detailed description of a preferred embodiment thereof, taken in conjunction with the accompanying drawings wherein like elements are designated by identical reference numerals throughout the several views, and in which.

DETAILED DESCRIPTION OF THE DRAWINGS

Figure 1:
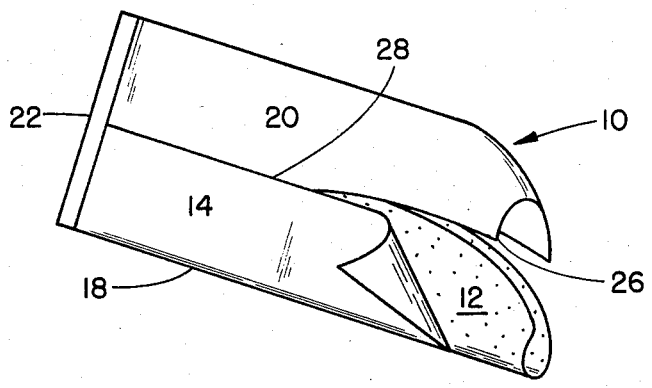
FIG. 1 illustrates a perspective view of an exemplary embodiment of a pocket wrap pursuant to the present invention having a taco extending therefrom.

Referring to the drawings in detail, FIG. 1 illustrates a perspective view of an exemplary embodiment of a pocket wrap 10 constructed pursuant to the teachings of the present invention and having a taco 12 extending therefrom, in a general position as might be suitable for the taco to be hand held within the overwrap while being consumed.

Figure 6:
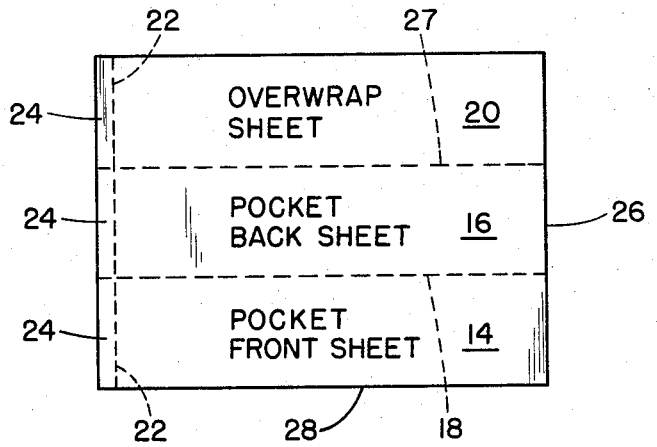
FIG. 6 illustrates an exemplary embodiment of a flat paper blank prior to folding and formation thereof into a pocket wrap pursuant to the teachings of the present invention.

Referring to both FIGS. 1 and 6, the pocket wrap of FIG. 1 is formed from one paper blank, as shown in FIG. 6, having a panel 14 forming the pocket front sheet, a panel 16 forming the pocket back sheet, and a panel 20 forming an overwrap sheet. The overwrap sheet 20 is formed generally integrally with the back sheet 16, having approximately the same length and width thereas.

Figure 5:
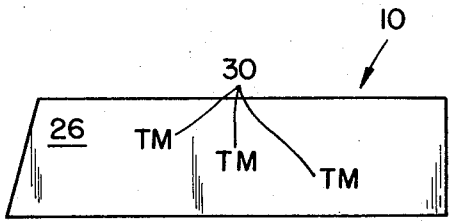
FIG. 5 is a rear illustration of the folded pocket wrap of FIG. 4, showing a decorative printed surface which overlays the back sheet of the pocket wrap and provides for printed graphics thereon to be registered with the product placement.

The pocket wrap is initially formed by folding the front sheet 14 upwardly and over the back sheet 16 along fold line 18. The left edge 22 of the pocket wrap is then formed by folding over a left tab 24 such that it extends inwardly from the left edge 22, and is joined to the remainder of the pocket wrap by a suitable adhesive or glue. As illustrated in FIG. 5, a decorative printed sheet 26 can be placed on to overlay the outer surface of the back or rear sheet 14 to provide for decorative and color printing thereon, for trademark and aesthetic purposes.

The pocket wrap is thus formed to provide a simple and versatile pocket wrap for a comestible product, with the pocket being formed by the front and back sheets 14 and 16, which are joined along both a first side edge 22 and a bottom edge 18, and which are openable and detached along both a second side edge 26 and a top edge 28. The relatively open pocket enables a comestible product such as a taco 12 to be easily inserted therein to a position as shown in FIG. 2.

Figure 3:
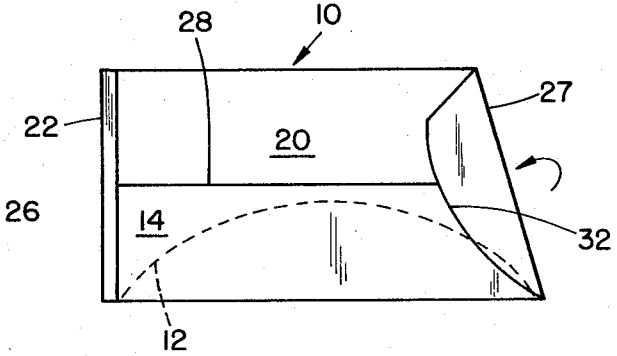
FIG. 3 illustrates the pocket wrap of FIG. 2 after an initiate first folding of the wrap.
Figure 4:
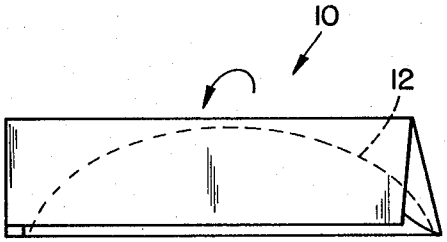
FIG. 4 illustrates the pocket wrap of FIGS. 1 and 2 after a second and final folding of the wrap.

As illustrated in FIGS. 3 and 4, the overwrap sheet 20 is designed to be folded downwardly along fold line 27 over the pocket front sheet after insertion of a comestible product into the pocket, thereby wrapping and packaging the comestible product in a manner suitable for initial delivery to a customer. The wrap can be initially folded along line 29, as illustrated in FIG. 3, to close the second side edge of the overwrap, and the overwrap can then be folded downwardly as illustrated in FIG. 4.

Figure 2:
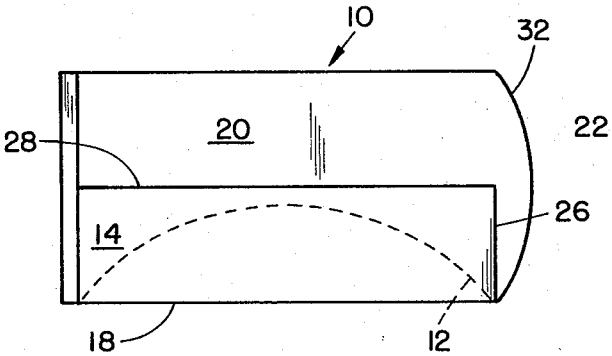
FIG. 2 is a plan view of a pocket wrap in accordance with the teachings of the present invention, illustrating in phantom the position of a taco inserted fully therein, prior to folding of the wrap.

The pocket wrap 10 of the subject invention, by starting with a pocket for the comestible product as shown in FIG. 2, reduces the wrapping time of the comestible product, a significant consideration in a typical fast food operation. Moreover, the pocket wrap can be constructed relatively inexpensively, a significant consideration for a fast food wrap, which is typically disposed of after a single usage, from an easily manufactured blank formed or a relatively inexpensive material such as paper, coated paper, or paper laminated to foil.

Moreover, the provision of a separate decorative printed sheet 26, which can be formed of a thicker coated sheet of paper, provides for decorative and trademark printing graphics 30 thereon, and also serves to reinforce the strength of the pocket. The decorative printed sheet 26 is preferably substantially coextensive with, or slightly smaller than, the rectangular pocket back sheet 16.

As illustrated in FIG. 6, in one preferred embodiment, both the pocket wrap blank and the resultant pocket wrap are generally rectangular in shape. However, as illustrated particularly by FIGS. 2 and 3, the generally rectangular shape can have rounded edges, as at 32. Moreover, the particular shape of the pocket wrap will depend, to a large extent, on the product being wrapped. A taco, burrito, hot dog or elongated sandwich can be wrapped with a wrap as illustrated in FIGS. 1 through 5. However, a squarer shape wrap might be more appropriate for hamburgers, sandwiches and soft pretzels.

While a preferred embodiment of the present invention for a pocket wrap is described in detail herein, it should be apparent that the disclosure and teachings of the present invention will suggest many alternative designs to those skilled in the art. For instance, the particular configuration of the overwrap shape and fold lines can vary in alternative embodiments, as can the type of paper or other alternative sheet material. The decorative printed sheet can be omitted, or the shape and placement of the trademark or other decorative printing thereon can also vary considerably in alternative embodiments.

A folded paperboard blank 10 is enclosed herewith in an attached envelope as a model for submission with this patent application.

What is claimed is:

1. A simple and versatile pocket wrap for a comestible product which is frequently hand held during consumption, comprising:

a. a substantially rectangular pocket adapted to enclose a comestible product which is frequently hand held during consumption, formed by front and back sheets which are joined along both a first side edge and a bottom edge, and which are openable and detached along both a second side edge and a top edge, said open second side and top edges of the pocket enabling a comestible product to be conveniently inserted into the pocket, and also allowing the comestible product to extend from the pocket for consumption while still being wrapped therein and hand held by a consumer, with the length of the top and bottom edges generally defining the length of the rectangular pocket and the length of the first and second side edges generally defining the width of the rectangular pocket;

b. a substantially rectangular overwrap sheet formed integrally with said pocket back sheet along a fold line and extending upwardly from said pocket, said overwrap sheet having a length and width substantially equal to the length and width of the rectangular pocket and being designed to be folded downwardly along said fold line to substantially completely overlie said pocket front sheet after a comestible product is inserted into the pocket, thereby wrapping and packaging the comestible product in a manner suitable for take out, and also enabling the product to be consumed by being relocated in the pocket so as to extend from said open second side or top edge; and c. said front and back sheets and said overwrap sheet being formed from one integral substantially rectangular sheet of paper with said front sheet, said back sheet and said overwrap sheet each comprising approximately one third of the area of the rectangular sheet, with the rectangular sheet being folded initially along said bottom edge joinder of said front and back sheets, and then folded a second time along said first side edge joinder of said front and back sheets and continuing up along said first side edge into the overwrap sheet, with a short inwardly extending tab being formed along said first side edge and extending from the overwrap sheet in which the tab is one sheet thick to the first side edge joinder of the front and back sheets where the tab is two sheets thick.

2. A simple and versatile pocket wrap for a comestible product as claimed in claim 1, said pocket back sheet having a decorative printed sheet overlaying an outer surface thereof opposite the surface facing the inside of the pocket, said decorative sheet providing for decorative and trademark printing thereon, and also reinforcing the strength of said pocket.

3. A simple and versatile pocket wrap for a comestible product as claimed in claim 2, said decorative printed sheet being generally rectangular in shape, and being substantially coextensive with, and slightly smaller than, said rectangular pocket back sheet.

4. A simple and versatile pocket wrap for a comestible product as claimed in claim 1, in combination with an elongated comestible product inserted into said rectangular pocket with the length of the elongated comestible product extending along the length of said pocket, and the substantially rectangular overwrap being folded downwardly along said fold line to substantially completely overlie the pocket front sheet.

5. A simple and versatile pocket wrap in combination with an elongated comestible product as claimed in claim 4, said elongated comestible product comprising a taco.

6. A simple and versatile pocket wrap in combination with an elongated comestible product as claimed in claim 4, said elongated comestible product comprising a burrito.

* * * * *